US006478508B1

(12) United States Patent
Magnani et al.

(10) Patent No.: US 6,478,508 B1
(45) Date of Patent: Nov. 12, 2002

(54) APPARATUS FOR LAYING UNDERGROUND ELECTRIC CABLES

(75) Inventors: Francesco Magnani, Pavia (IT); Mario Genovesi, Cremona (IT); Danilo Caslini, Caprino Bergamasco (IT)

(73) Assignee: Pirelli Cavi E Sistemi S.p.A., Milan (IT)

( * ) Notice: Subject to any disclaimer, the term of this patent is extended or adjusted under 35 U.S.C. 154(b) by 0 days.

(21) Appl. No.: 09/981,799

(22) Filed: Oct. 19, 2001

Related U.S. Application Data

(63) Continuation of application No. PCT/EP00/03358, filed on Apr. 14, 2000.
(60) Provisional application No. 60/135,649, filed on May 24, 1999.

(30) Foreign Application Priority Data

Apr. 19, 1999 (EP) ..... 99830226

(51) Int. Cl.[7] ..... E02F 5/10; F16L 1/028
(52) U.S. Cl. ..... 405/179; 405/174; 405/184; 405/154.1
(58) Field of Search ..... 405/154.1, 174, 405/179–184

(56) References Cited

U.S. PATENT DOCUMENTS

| | | | | |
|---|---|---|---|---|
| 2,738,745 A | | 3/1956 | Harpold | |
| 3,203,188 A | | 8/1965 | Evans | |
| 3,429,134 A | * | 2/1969 | Coffey | 405/179 |
| 3,831,388 A | | 8/1974 | Wells | |
| 4,028,902 A | * | 6/1977 | Courson et al. | 405/179 X |
| 4,050,261 A | | 9/1977 | Brewer et al. | |
| 4,714,381 A | | 12/1987 | Hatch | |
| 5,573,347 A | | 11/1996 | Miles et al. | |

FOREIGN PATENT DOCUMENTS

| | | |
|---|---|---|
| EP | 0 251 876 | 1/1988 |
| EP | 0 585 188 | 3/1994 |
| FR | 2 697 550 | 5/1994 |
| GB | 410900 | 5/1934 |

OTHER PUBLICATIONS

Donazzi et al.; "Soil Thermal and Hydrological Characteristics in Designing Underground Cables", Proc. IEE, vol. 126, No. 6, Jun. 1979.

* cited by examiner

*Primary Examiner*—Heather Shackelford
*Assistant Examiner*—Sunil Singh
(74) *Attorney, Agent, or Firm*—Finnegan, Henderson, Farabow, Garrett & Dunner, LLP

(57) ABSTRACT

An apparatus for laying underground electric cables, in particular for high-voltage lines, having a vehicle towable along a trench and carrying, on a first van, a first deposition unit adapted to form a base layer of inert material for heat dissipation at the trench bottom. Mounted on the first van is a guide structure engaging the cable for laying it on the base layer previously compacted by a vibrating plate. A second van carries a second deposition unit forming a covering layer of inert material upon the previously laid-down base layer and cable.

14 Claims, 3 Drawing Sheets

APPARATUS FOR LAYING UNDERGROUND ELECTRIC CABLES

CROSS REFERENCE TO RELATED APPLICATIONS

This application is a continuation of International Application No. PCT/EP00/03358, filed Apr. 14, 2000, and claims the priority of EP99830226.9, filed Apr. 19, 1999, and the benefit of U.S. Provisional application No. 60/135,649, filed May 24, 1999, the content of which is incorporated by reference herein.

The present invention relates to an apparatus for laying underground electric cables.

In more detail, said apparatus is intended for laying electric cables in a trench, in particular when medium- or high-voltage cables and preferably high-voltage cables are concerned, of a value as high as, or greater than 150 kV, where arrangement of a mass of inert material of suitable thickness around the cable is particularly wished, which mass, in addition to performing a function of mechanical protection of the cable, also enables dissipation of the heat generated by the cable when passed through by current.

Laying of electric cables for accomplishment of medium- or high-voltage earth lines usually takes place within trenches digged in the ground.

On laying, the cable is incorporated into a mass of inert material, e.g. sand or poor concrete, usually carrying out a mechanical protection of the cable itself (see U.S. Pat. No. 4,050,261, for example, and the article by F. Donazzi, E. Occhini, A. Seppi, "Soil thermal and hydrological characteristics in designing underground cables", Proc. IEE, Vol. 126, No. 6, June '79).

In more detail, for cable laying it is required that preliminarily a base layer of inert material should be laid down at the bottom of a trench, previously made by an excavation operation. The cable unwound from a reel is then deposited onto the base layer.

Subsequently, a covering layer of inert material is deposited so as to form, with the previously deposited base layer, a mass of inert material completely incorporating the cable. The Applicant has perceived that laying of cables carried out by manual operations, in addition to involving an important loss of time and manpower, does not offer sufficient assurances as regards achievement of the prescribed technical features in the inert material placed around the cable. The Applicant has also become aware of the fact that the thermal features of this material can vary to a great extent depending on the compacting degree given to the material during installation and that this compacting degree, if the material is laid down manually, is not very uniform and cannot be easily checked.

Document EP 0 585 188 A1 discloses an apparatus for laying underground electric cables comprising: a vehicle longitudinally movable along a trench arranged to receive at least one electric cable; a first deposition unit to form a base layer of inert material at the bottom of said trench, said first deposition unit comprising at least a first conveying duct connected at the upper part thereof with feed means for said inert material and at the lower part thereof with a downwardly-turned discharge opening; at least one guide structure, having an inlet end portion turned towards the vehicle front, to engage at least one stretch of said cable extended over the trench, and an outlet end portion disposed at a lower position and turned to the back of the first deposition unit for laying the cable on said base layer; a second deposition unit operating at the rear of the guide structure to form a covering layer of inert material upon the base layer and the cable.

In accordance with the present invention, laying of underground electric cables is made by an apparatus characterized in that the guide structure has at least one portion laterally disposed relative to said first conveying duct.

Preferably, said apparatus further comprises at least a first compacting unit operatively interposed between the first deposition unit and the outlet end portion of said guide structure for compacting the base layer deposited at the trench bottom.

In more detail, this compacting unit comprises a vibrating plate acting against the base layer by a lower surface thereof preferably having a substantially V-shaped cross-section outline. Preferably, said V-shaped outline has a rounded vertex in the form of an arc of a circle of a radius substantially corresponding to half diameter of the cable.

Advantageously, said first conveying duct and said first discharge opening have a width reduced by an amount of at least 10% relative to the width of said trench.

Preferably, the first discharge opening is delimited at the rear part thereof by an outlet edge disposed at a higher level than the lower surface of said vibrating plate. The vibrating plate, in turn, has a lead-in portion rising from said lower surface in the direction of the outlet edge of the discharge opening, and terminating at a higher level than said outlet edge.

At least one presser roller elastically acting against the cable to push it towards the base layer laid at the trench bottom may be advantageously associated with the outlet end portion of the guide structure.

The second deposition unit may advantageously comprise a second conveying duct connected at the upper part thereof with feed means for said inert material, and at the lower part thereof with a second downwardly-turned discharge opening.

Preferably, said second conveying duct and said second discharge opening have a width reduced by an amount of at least 10% relative to the trench width.

Furthermore, with the second deposition unit may be associated adjustment means operating at an outlet edge located at the rear of the second discharge opening to adjust thickness of said covering layer.

In accordance with a further aspect of the present invention, the vehicle comprises a first van and a second van removably engaged in mutual alignment and carrying the first deposition unit and second deposition unit, respectively.

Moreover, said vehicle may comprise adjustable suspension means operatively associated with respective wheels of the vehicle for modifying the height of said first and second deposition units and of said guide structure relative to the trench bottom.

Preferably, said first and second vans are mutually in engagement by at least one fluid-operated connecting actuator.

Further features and advantages will become more apparent from the detailed description of a preferred, non exclusive, embodiment of an apparatus for laying underground electric cables, in accordance with the present invention. This description will be set forth hereinafter with reference to the accompanying drawings, given by way of non-limiting example, in which.

Figure 1:
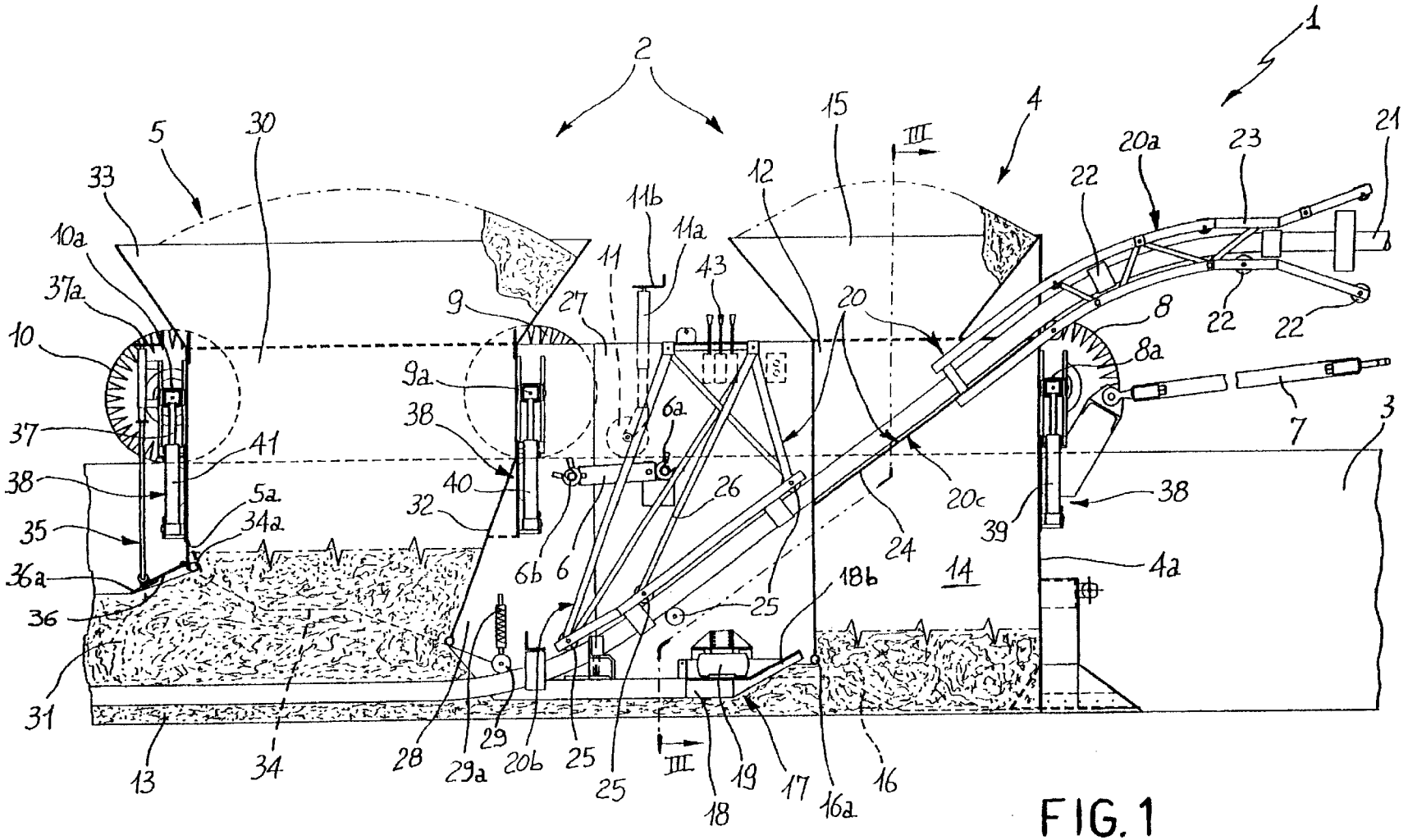
FIG. 1 is a diagrammatic side view, partly in section, of an apparatus in accordance with the present invention, during laying of an electric cable in a trench.
Figure 2:
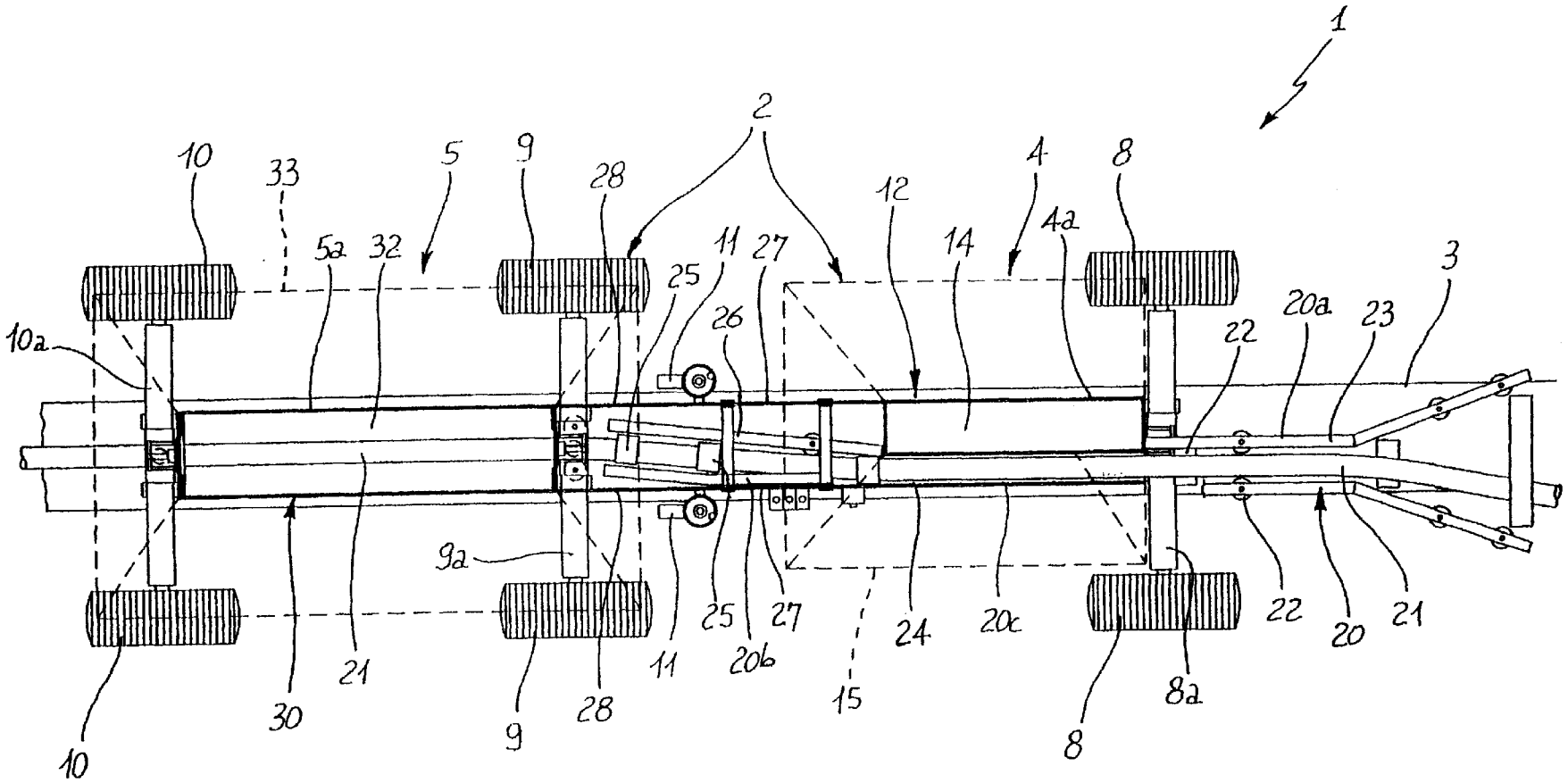
FIG. 2 is a partially fragmentary top view of the apparatus of FIG. 1.

With reference to the drawings, an apparatus for laying underground electric cables in accordance with the present invention has been generally identified by reference numeral 1. Apparatus 1 essentially comprises a vehicle 2 lending itself to be longitudinally moved over a trench 3 previously dug in the ground.

Advantageously, vehicle 2 is essentially comprised of a first van 4 and a second van 5 removably linked in mutual alignment, first van 4 being disposed at the front relative to the feed direction of the vehicle itself.

Preferably, the mutual engagement between first and second vans 4, 5 is obtained by at least one fluid-operated connecting actuator 6, having one end 6*a* hinged along a horizontal axis at the rear of first van 4 and a second end 6*b* carrying a hooking element to be operatively engaged in a respective housing arranged at the front of second van 5. Upon the action of fluid-operated actuator 6, the hooking element lends itself to be moved away from or close to first van 4 in order to facilitate engagement with second van 5 and enable subsequent displacement of the two vans close to each other, even in the presence of possible misalignments between them.

Preferably, vehicle 2 is arranged to be towed by a tractor, not shown, through a drawbar 7 linked at the front with first van 4. Associated with first van 4 is a pair of front wheels 8 mounted on a first axle 8*a,* whereas second van 5 is provided with two pairs of wheels, front wheels 9 and rear wheels 10 respectively, which are mounted on a second and a third axles 9*a,* 10*a,* respectively.

A pair of auxiliary rollers 11, associated with first van 4 at the rear thereof and adapted to be positioned in a vertical direction by means of telescopic supports 11*a* equipped with an adjustment handwheel 11*b* are suitable for conveniently supporting the rear portion of the first van when the latter is disengaged from second van 5.

Associated with first van 4 is a first deposition unit 12 adapted to form a base layer 13 of inert material for heat dissipation at the bottom of trench 3. The employed inert material may consist for example of poor concrete which, just as an indication, will contain sand mixed with cement in a percentage included between 5 and 10% by weight and water in a percentage included between 8 and 10% by weight.

For this purpose, first deposition unit 12 essentially comprises at least a first conveying duct 14 vertically extending towards the bottom of trench 3 and connected, at the upper part thereof, with feed means for the inert material, e.g. consisting of a first loading hoop 15. The lower portion of first conveying duct 14 terminates with a first downwardly-facing discharge opening 16, close to the bottom of trench 3.

Advantageously, first conveying duct 14 is delimited by perimetric walls substantially defining a bearing framework or chassis 4*a* for first van 4, to which first axle 8*a* is applied, as well as the other components associated with the first van.

First conveying duct 14 and first discharge opening 16 are also advantageously provided to have a width reduced by an amount of at least 10%, and preferably included between 15 and 25%, relative to the nominal width of the trench.

First discharge opening 16 is delimited at the back by an outlet edge 16*a* preferably disposed at a raised position relative to the remaining perimetric extension of the outlet opening itself, at a given distance from the bottom of trench 3, just as an indication included between 250 mm and 400 mm. Consequently, following to the forward movement of vehicle 2 along trench 3, the inert material flowing into first discharge opening 16 through first conveying duct 14 is laid down on the trench bottom to form a base layer 13 of a starting thickness corresponding to the distance of outlet edge 16*a* from the trench bottom.

Preferably, apparatus 1 further comprises at least one compacting unit 17, operating immediately downstream of first deposition unit 12, with reference to the feed direction of vehicle 2 along trench 3, in order to compact base layer 13 previously deposited on the trench bottom.

In more detail, compacting unit 17 comprises at least one vibrating plate 18, oscillatably linked to first van 4, e.g. by elastic supports, and driven by a motor 19 provided with an eccentric device to impart a vibratory motion to the plate itself.

Figure 3:
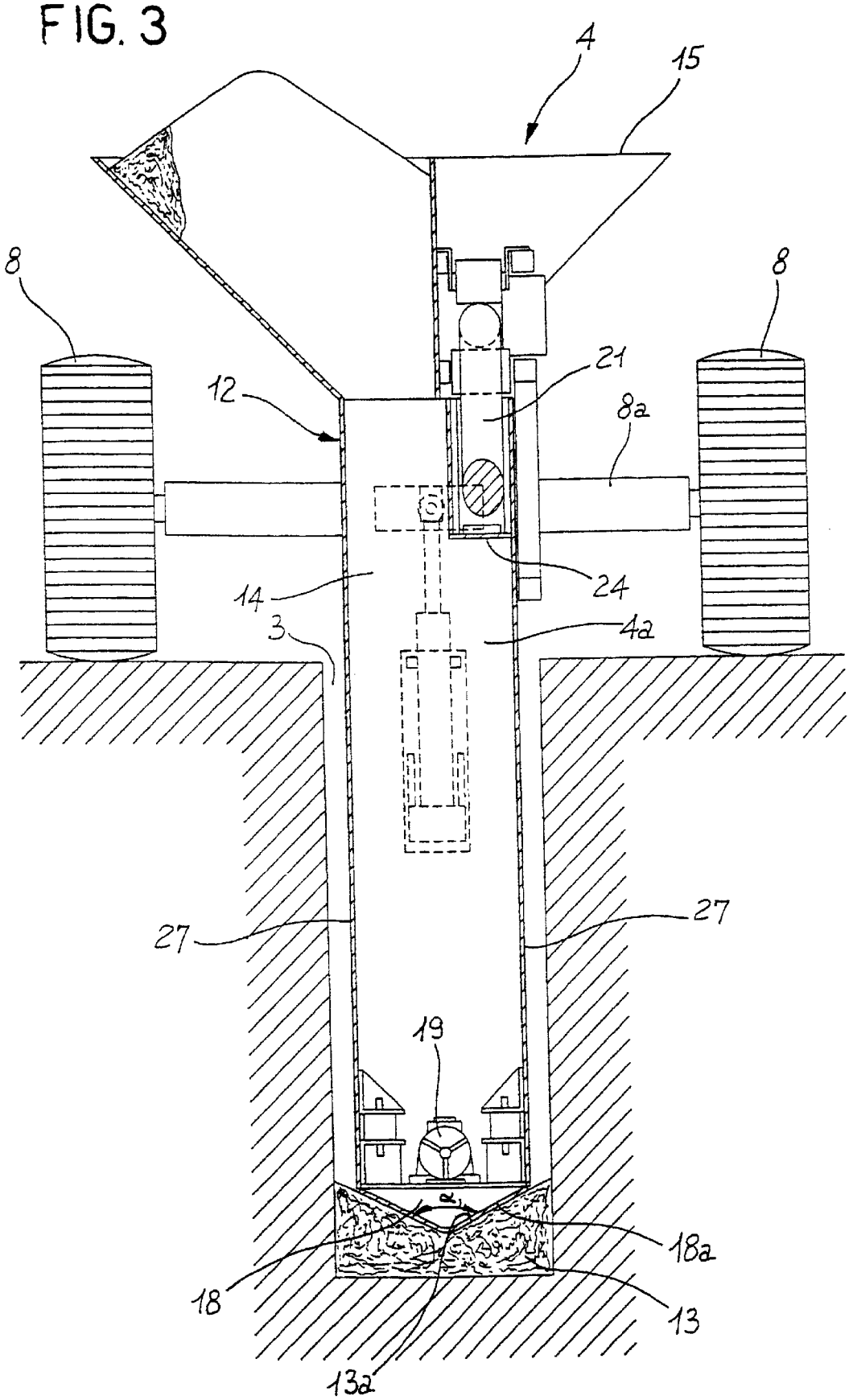
FIG. 3 is a sectional view taken along line III—III of FIG. 1.

Vibrating plate 18 acts against base layer 13 by a lower surface 18*a* thereof preferably having a shaped cross-section outline, adapted to interact with a predetermined portion of the cable surface. Preferably, said outline is substantially V-shaped, as clearly shown in FIG. 3, according to a summit angle "$\alpha$" advantageously included between 100° and 160°, and preferably of 130°. In addition, the vertex of the V-shaped outline of lower surface 18*a* of vibrating plate 18 is preferably provided to be radiused according to an arc of a circle of a radius substantially corresponding to half the diameter of electric cable 21 to be laid in trench 3.

Advantageously, outlet edge 16*a* of the first discharge opening is disposed at a raised level relative to lower surface 18*a* of vibrating plate 18. Vibrating plate 18, in turn, has a lead-in portion 18*b* rising from lower surface 18*a* in the direction of outlet edge 16*a,* and terminating at a higher level than said edge.

Due to the action of e vibrating plate 18, the inert material forming base layer 13, initially laid down with a width corresponding to that of first conveying duct 14 and of first discharge opening 16, is compacted and moved towards the side walls of the trench.

Consequently, when the passage of vibrating plate 18 has been completed, base layer 13 takes up the whole width of trench 3, and even compensates for possible unevennesses inevitably produced during excavation, and has an upper surface 13*a* with a substantially V-shaped cross-section outline. The minimum detectable thickness on base layer 13 after passage of vibrating plate 18 is included, just as an indication, between 80 and 120 mm.

Furthermore, apparatus 12 comprises at least one guide structure 20, having an inlet end portion 20*a* turned to the front of vehicle 2, an outlet end portion 20*b* disposed below and turned to the back of first deposition unit 12, and an intermediate portion 20*c* extending between the inlet and outlet end portions 20*a* and 20*b*.

Inlet end portion 20*a* comprises at least one front trestle 23 removably fastened to first van 4, e.g with the aid of extractable pegs or equivalent removable connecting means. More particularly, front trestle 23, having an upper portion susceptible of being opened, is externally in engagement with first conveying duct 14, close to the upper end of said duct, and has a substantially funnel-shaped lead-in portion 23*a* supported in cantilevered fashion at the front of first van 4 to longitudinally engage an electric cable 21 at the inside thereof, in particular a high-voltage electric cable of the fluid-oil-cooled type.

Cable 21 comes for example from a reel placed before vehicle 2. Alternatively, cable 21 can be previously laid down on the ground along one side of trench 3. In both cases cable 21, when engaged through the guide structure, has at least one section thereof substantially longitudinally outstretched over trench 3, before vehicle 2.

Inlet end portion 20*a* further comprises a plurality of front rollers or equivalent sliding members 22, at least partly rotatably supported by front trestle 23 and such distributed that they cause cable 21 to be obliquely deviated downwardly, along a curvilinear path of travel of a sufficiently wide radius of curvature, at all events not lower than the admissible minimum radius for the cable itself. By way of example, for a 400 kV electric cable 21, of an outer diameter of 100 mm, with a linear weight of 27 kg/m, the admissible minimum radius of curvature is 1.75 meters.

Downstream of inlet end portion 20*a,* cable 21 travels over central portion 20*c* of a substantially rectilinear extension, that for the above cable has a length substantially equal to 2 meters, being obliquely oriented downwardly away from the inlet end portion itself. Preferably this central portion 20*c* is defined, at a laterally outer position relative to first conveying duct 14, by an inclined sliding surface 24 formed in the side walls delimiting the conveying duct itself.

Rear end portion 20*b,* in turn, comprises a plurality of externally-disposed rear sliding rollers or equivalent sliding members 25, located downstream of first conveying duct 14, to horizontally deviate cable 21 on the longitudinal centre line of trench 3 and close to the trench bottom, following a curvilinear path of travel of a radius of curvature not lower than the admitted minimum radius of curvature for the cable itself.

At least part of rear sliding rollers 25, and more specifically at least those rollers arranged to act above cable 21, are rotatably supported by a rear trestle 26 removably engaged, e.g. by extractable pegs or equivalent removable connection means, between two rear side walls 27 parallelly spaced apart and rearwardly projecting relative to first conveying duct 14.

Remaining sliding rollers 25, that are not supported by rear trestle 26, are rotatably in engagement directly with side walls 27 and/or between auxiliary side walls 28 provided at the front of second van 5 in the extension of rear side walls 27.

At the end of rear end portion 20*a,* is also advantageously provided at least one presser roller 29 elastically acting against cable 21 to push it towards base layer 13 laid down at the bottom of trench 3. In more detail, as diagrammatically shown in FIG. 1, presser roller 29 is rotatably supported between two runners (not shown in the figure) vertically sliding along guides integral with auxiliary side walls 28 and elastically loaded by at least one spring 29*a* pushing the presser roller downwardly.

Second van 5 carries a second deposition unit 30 operating at the rear of guide structure 20 to form at least one covering layer 31 of inert material of appropriate thickness, just as an indication included between 500 and 800 mm, on top of base layer 13 and cable 21.

In the same manner as described with reference to first deposition unit 12, second deposition unit 30 essentially comprises a second conveying duct 32 substantially extending in a vertical direction towards the bottom of trench 3 and delimited by perimetric walls substantially defining bearing structure 5*a* of second van 5, with which second and third axles 9*a,* 10*a* are engaged, as well as all other members associated with the second van.

Second conveying duct 32 terminates at the upper part thereof with a second loading hopper 33 or equivalent feed means for the inert material intended to form covering layer 31.

On the opposite side from loading hopper 33, second conveying duct 32 terminates with a second downwardly-turned discharge opening 34. Advantageously, second conveying duct 32 and second discharge opening 34 have a maximum width which is reduced by an amount of at least 10%, and preferably included between 15 and 25%, relative to the nominal width of trench 3.

Second discharge opening 34 is delimited at the back by an outlet edge 34*a* defining the maximum deposition thickness of covering layer 31.

Preferably, adjustment means 35 operates at said outlet edge 34*a* in order to adjust covering layer 31 thickness between a minimum value and said maximum value defined by the outlet edge itself.

Said adjustment means 35 preferably comprises at least one partition 36 hinged along outlet edge 34*a* of second discharge opening 34 and adjustable as regards orientation by means of a driving handwheel 37*a* acting on an adjusting screw 37. Partition 36 has an end edge 36*a* to be positioned relative to outlet edge 34*a,* depending on the orientation taken by the partition itself and acting like a doctor blade on covering layer 31 to level it to the desired height, simultaneously causing a side displacement of said layer so as to fill trench 3 according to the whole width of same.

Moreover, in accordance with a further preferred feature of the invention, apparatus 1 comprises adjustable suspension means 38 operatively associated with front wheels 8, 9 of first and second vans 4, 5 as well as with rear wheels 10 of second van 5, to modify the height of first and second deposition units 12, 30, as well as of guide structure 20 and of compacting unit 17, relative to trench 3 bottom.

Preferably, this suspension means 38 essentially comprises a first fluid-operated levelling actuator 39 operating between bearing structure 4*a* of first van 4 and first axle 8*a* of front wheels 8, a second fluid-operated levelling actuator 40 operating between bearing structure 5*a* of second van 5 and axle 9*a* of front wheels 9 of the second van itself, as well as a third fluid-operated levelling actuator 41 operating between bearing structure 5*a* of second van 5 and axle 10*a* of rear wheels 10. First, second and third levelling actuators 39, 40 and 41, as well as actuator 6 for connection between first and second vans 4, 5 are hydraulically driven by a distribution and control box 43 fed with fluid under pressure supplied from a feed unit that can be installed on a tractor for towing vehicle 2, for example.

Cable laying by the above described apparatus takes place as follows.

As vehicle 2 is towed along trench 3, the inert material coming from first loading hopper 15 along first conveying duct 14 is deposited to the bottom of trench 3 and compacted by vibrating plate 18, so as to form base layer 13 with substantially V-shaped upper surface 13*a*. The height of base layer 13 can be easily adjusted by first levelling actuator 39. Simultaneously, electric cable 21 runs over guide structure 20 and is then guided towards trench 3 bottom to be deposited therein, close to the longitudinal centre line of same, at the bottom of the V-shaped outline exhibited by upper surface 13*a* of base layer 13. It is to be noted that, advantageously, while cable 21 is being passed through whole guide structure 20, it is conveniently guided according to a predetermined path of travel enabling the cable itself to reach base layer 13 without being submitted to too many stresses and/or deformations that could damage it. The action of spring 29*a* on presser roller 29 ensures that, on laying of cable 21 against base layer 13, said cable is not subjected to too many stresses also due to possible displacements in height undergone by first and/or second vans 4, 5, e. g. as a result of unevennesses encountered on the ground or for other reasons.

Passage of second deposition unit 30 over base layer 13 and cable 21 causes formation of covering layer 31 of a thickness adjusted by adjustable partition 36.

Furthermore, a second compacting unit operating on the covering layer 31 may be associated with apparatus 1 immediately downstream of second deposition unit 30, in the same manner as described with reference to compacting unit 17.

In fact, said apparatus enables laying of underground electric cables, in particular for high-voltage lines, to be carried out in an automated manner and with an important saving of time and manpower costs.

Moreover, the automated laying carried out by said apparatus ensures constancy in the thickness and compacting degree of the mass of inert material placed around the cable.

Thus a perfect correspondence between the heat dissipation degree and the planned data is ensured, excess deposition of inert material being also avoided.

The high degree of compactness carried out by compacting unit 17 causes an advantageous side displacement of inert material that will occupy the whole trench width, in spite of the reduced width of conveying duct 14 and discharge opening 16.

Due to the reduced sizes in width of the discharge ducts, movement of the whole vehicle along the trench is facilitated, without interferences occurring with the trench side walls, even in the presence of bends along the longitudinal extension of the trench itself.

An easy running of the vehicle along the curved lengths of the trench extension is also facilitated by the arrangement of first and second deposition units 12, 30 on two distinct vans 4, 5, consecutively linked with each other in an articulated manner. In addition, due to the arrangement of two vans 4, 5 that can be released from each other, cable 21 can be easily disengaged from whole guide structure 20 in case of emergency, e.g. for carrying out possible repairings or if, due to any other event, removal of apparatus 1 from the partly laid cable should be required.

In fact, in this case, second van 5 can be unhooked and moved away from first van 4, to enable free access to cable 21 along guide structure 20. Front trestle 23 can be opened by lifting its upper portion, and rear trestle 26 can be removed to free the cable from guide structure 20, after optionally moving van 4 forward, to enable engagement of the cable stretch coming out of the trench with an appropriate support structure resting on the ground.

Furthermore, said apparatus ensures cable laying in a complete absence of too many stresses and/or deformations of the cable itself. This aspect is of particular importance above all when high-voltage electric cables of the fluid-oil type are concerned, which cables are to be handled with particular care.

It is also to be noted that formation of base layer 13*b* with an upper surface 13*a* having a V-shaped outline ensures an advantageous holding of cable 21 at a centred position in trench 3 and enables accomplishment of a complete and even covering of the cable with the inert material forming the base and covering layers. Achievement of the above result, furthermore facilitated by the fact that the vertex of the V-shaped outline is radiused, would be hardly reached if the base layer should be deposited in such a manner as to exhibit a flat upper surface, because the inert material would find it difficult to fill the undercut space that would be created between the lower and upper cable portions.

What is claimed is:

1. An apparatus for laying at least an underground electric cable, comprising:

a vehicle longitudinally movable over a trench arranged to receive at least one electric cable;

a first deposition unit to form a base layer of inert material at the bottom of said trench, said first deposition unit comprising at least a first conveying duct connected at the upper part thereof with feed means for said inert material and at the lower part thereof with a downwardly-turned first discharge opening;

at least one guide structure, having an inlet end portion turned towards the vehicle front, to engage at least one stretch of said cable, and an outlet end portion disposed at a lower position and turned to the back of the first deposition unit for laying the cable on said base layer, said guide structure having at least one central portion laterally disposed relative to said first conveying duct; and a second deposition unit operating at the rear of the guide structure to form a covering layer of inert material upon the base layer and the cable.

2. An apparatus as claimed in claim 1, further comprising at least a first compacting unit operatively interposed between the first deposition unit and the outlet end portion of said guide structure for compacting the base layer deposited at the trench bottom.

3. An apparatus as claimed in claim 3, wherein said compacting unit comprises a vibrating plate acting the base layer by a lower surface thereof having a substantially V-shaped cross-section outline.

4. An apparatus as claimed in claim 3, wherein said V-shaped outline has a rounded vertex in the form of an arc of a circle of a radius substantially corresponding to half the diameter of the cable.

5. An apparatus as claimed in claim 3, wherein said first discharge opening is delimited at the rear part thereof by an outlet edge disposed at a higher level than the lower surface of said vibrating plate.

6. An apparatus as claimed in claim 5, wherein said vibrating plate has a lead-in portion rising from said lower surface in the direction of the outlet edge of the discharge opening, and terminating at a higher level than said outlet edge.

7. An apparatus as claimed in claim 1, wherein said first conveying duct and said first discharge opening are respectively configured to have widths no more than 90% of a width of a trench in which said first conveying duct and said first discharge opening are disposed.

8. An apparatus as claimed in claim 1, wherein at least one presser roller is associated with the outlet end portion of the guide structure and it acts elastically against the cable to push it towards the base layer laid at the trench bottom.

9. An apparatus as claimed in claim 1, wherein said second desposition unit comprises a second conveying duct connected at the upper part thereof with a feed means for said inert material, and at the lower part with a downwardly-turned second discharge opening.

10. An apparatus as claimed in claim 9, wherein said second conveying duct and said second discharge opening are respectively configured to have widths no more than 90% of a width of a trench in which said second conveying duct and said second discharge opening are disposed.

11. An apparatus as claimed in claim 9, wherein said second deposition unit has adjustment means operating at an outlet edge located at the rear of the second discharge opening to adjust thickness of said covering layer.

12. An apparatus as claimed in claim 1, wherein said vehicle comprises a first van and a second van removably engaged in mutual alignment and respectively carrying the first deposition unit and second deposition unit.

13. An apparatus as claimed in claim 12, wherein said first and second vans are mutually in engagement by means of at least one fluid-operated connecting actuator.

14. An apparatus as claimed in claim 1, wherein said vehicle comprises adjustable suspension means operatively associated with respective wheels of the vehicle for modifying the height of said first and second deposition units and of said guide structure relative to the trench bottom.

* * * * *

UNITED STATES PATENT AND TRADEMARK OFFICE

CERTIFICATE OF CORRECTION

PATENT NO. : 6,478,508 B1
DATED : November 12, 2002
INVENTOR(S) : Francesco Magnani It is certified that error appears in the above-identified patent and that said Letters Patent is hereby corrected as shown below:

Column 9,
Line 6, "claim 3" should read -- claim 2 --.
Line 7, after "acting" insert -- against --.

Column 10,
Line 6, after "part" insert -- thereof --.

Signed and Sealed this

Twentieth Day of May, 2003

JAMES E. ROGAN
*Director of the United States Patent and Trademark Office*